United States Patent [19]

Nelson

[11] 3,999,402

[45] Dec. 28, 1976

[54] CAM DRIVE PUMP REFRIGERATORS

[76] Inventor: Daniel E. Nelson, 4875 Sand Lake Road, Orlando, Fla. 32809

[22] Filed: Apr. 22, 1974

[21] Appl. No.: 462,982

[52] U.S. Cl. ..... 62/403; 62/498

[51] Int. Cl.[2] ..... F25D 9/00

[58] Field of Search ..... 62/401, 403, 498

[56] References Cited

UNITED STATES PATENTS

| | | | |
|---|---|---|---|
| 255,895 | 4/1882 | Starbuck | 62/403 |
| 668,540 | 2/1901 | Ostergren | 62/403 |
| 2,903,862 | 9/1959 | Bouchard | 62/403 |

FOREIGN PATENTS OR APPLICATIONS

| | | | |
|---|---|---|---|
| 810,857 | 3/1959 | United Kingdom | 62/403 |

*Primary Examiner*—William E. Wayner
*Assistant Examiner*—Ronald C. Capossela

[57] ABSTRACT

A double-acting cam drive piston pump-refrigerator having a double-acting expander piston and a compact heat exchange condenser and evaporator with high density arrangement of heat exchange material.

5 Claims, 2 Drawing Figures

CAM DRIVE PUMP REFRIGERATORS

CROSS REFERENCE TO OTHER APPLICATIONS

This application is related to applicant's U.S. Pat. No. 3,914,958.

SUMMARY

Prior practice in refrigeration expander pistons has been to use a crankshaft device to recover power from the stored energy condition of compressed coolant in a condenser. A vane pump has been used also with compression on one side and pressure recovery take off at the other side of the vane compressor. But both of these systems have basic inefficiencies. The piston approach has the inefficiencies of the crankshaft system with respect to its conversion of power between rotation and reciprocation. The vane pump has inefficiencies of sealing such that it cannot obtain high compression and also it doesn't have high power take-off efficiency because of an inherent low-pressure area ratio at the time pressure is initially released from the condenser into the expandor side of the vane pump. Condensers and evaporators in prior practice have depended on fan movement of air over surfaces or have used water or some other cooling agent other than air. In the using of air with a fan, an extremely high rate of flow of air is required. There is a low rate of heat transfer to the heat exchange air at the outside of the condenser and the evaporator. The power required to run the high air flow rate fan, or water or other liquid cooling agent, is actually as high or higher than is required to pump air under pressure around the outsides of the condenser and evaporator with high density of heat exchange fins or other material at the outsides of these heat exchange components.

Taking these factors into consideration, the objects of this invention are to provide refrigeration with a device having the following features and advantages: low-weight; high-efficiency double-acting piston compressor with high efficiency cam drive; an expander piston that is double-acting and attached to the same shaft that operates the double-acting compressor system such that work of compression is recovered directly from the compressor to utilize the essential work expended during expansion to reduce power required for compression; a compact condenser that requires far less volume and space than present condensers owing to the high density of the heat exchange material both inside and outside compressed coolant tubing; the above latter features for an evaporator; a high efficiency pump for conveying heat exchange air around the outside of the condenser and evaporator, and balanced opposed piston action with cam drive.

DESCRIPTION OF PREFERRED EMBODIMENT

Figure 1:
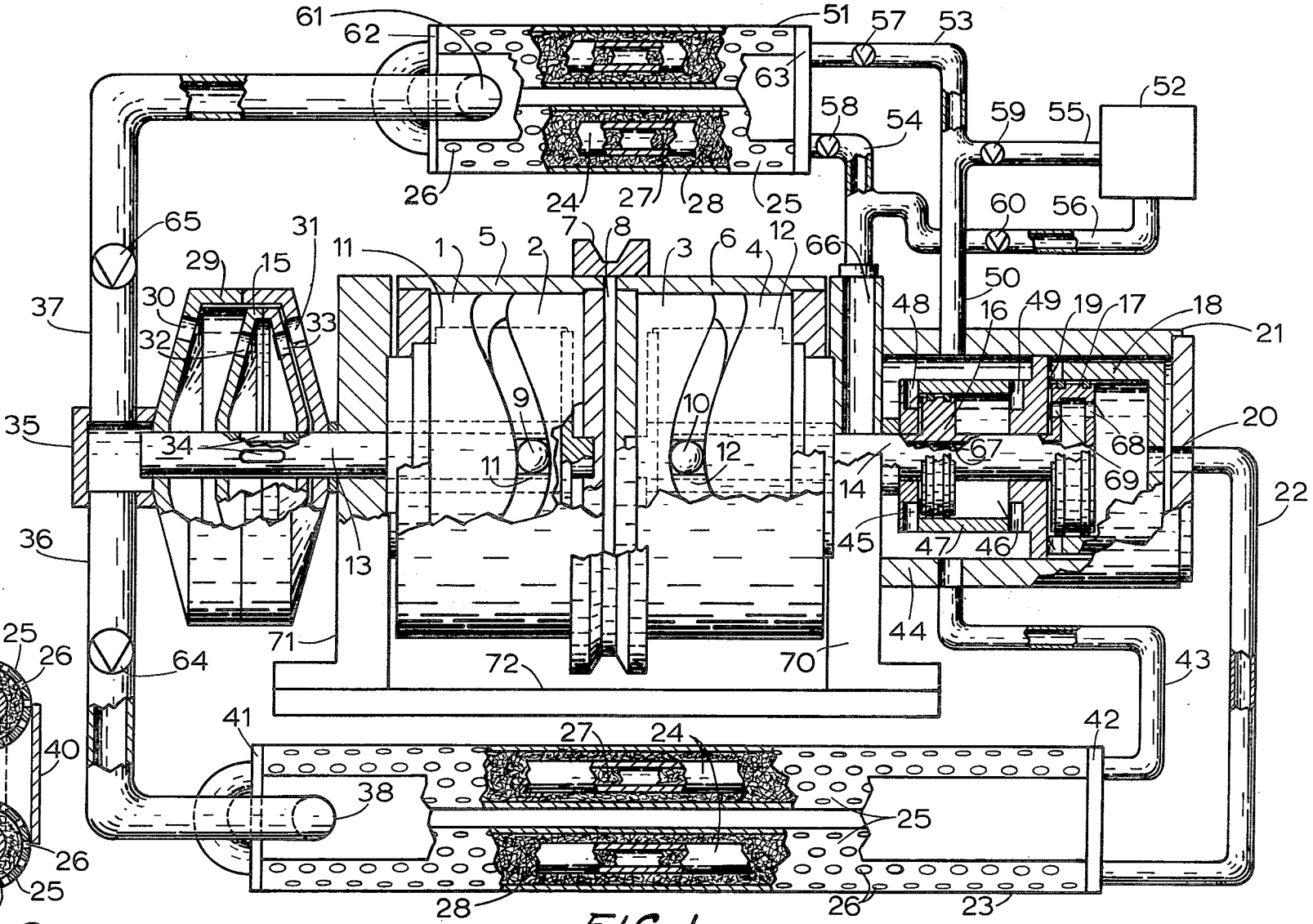
FIG. 1 is a cutaway side view of the entire device showing each component.
Figure 2:
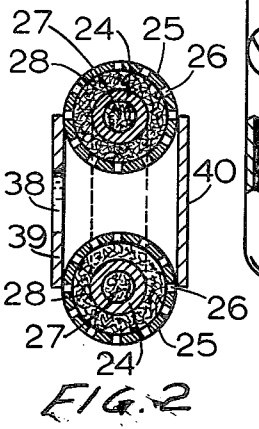
FIG. 2 is a section view of the heat exchange components for both the compressor and the evaporator. It is taken at the entry of a conveyance from the heat exchange air compressor into the heat exchange unit.

Counter-beveled cams 1 and 2 are positioned in opposing cam drive relationship to counter-beveled cams 3 and 4 at the inside periphery of cam drive sleeves 5 and 6 which are in turn attached to rotary power source

7. Rotary power source 7 can be either a take-off wheel as shown in the drawing or it can be a prime mover or electrical or other motor. If it is a prime mover or a motor, the cam drive sections enclosed by the separate sleeves can be separated such that the space 8 is widened for the optional prime mover or motor.

Drive teeth 9 and 10 shown here as circular members are caused to reciprocate in opposite direction by the rotation of the sleeves. Rotation of the teeth is prevented and only linear action allowed by grooves or channels linearly constructed in transverse guide members 11 and 12.

Opposed reciprocating travel of the drive teeth is transferred to power shafts 13 and 14 by attachment of the drive teeth which can be referred to also as cam followers to the power shafts. The opposed reciprocating action causes a heat exchange piston 15 at one side of the power source to reciprocate in the opposite direction to an expander piston 16 and compressor pump piston 17 at the opposite sides of the power source.

The compressor piston is caused thereby to travel in reciprocating action in compressor cylinder 18 and to pump coolant utilized in the system out of this cylinder in double-acting motion at each end of said cylinder through ports with one-way valves 19 and 20. The coolant is collected in plenary chamber 21 and directed through compressor outlet tube 22 to condenser 23.

The condenser is made up of a preferably U-shaped tube 24 positioned inside of a tube at each leg of the U and having holes 26. Densely positioned heat exchange material 27 is placed inside the tubes and densely positioned heat exchange material 28 is positioned outside the tubes. The densely positioned heat exchange material can be comprised of metallic shavings or chips or conductor material compressed tightly inside the tubes or compressed so tightly and heated that the material bonds together and the outside tubes 28 are not required.

The high density of the heat exchange method employed requires a positive displacement form of pump rather than a fan because air or other heat exchange media cannot easily penetrate such material or such density of heat exchange material. The heat exchange piston 15, therefore, is used to compress air from heat exchange cylinder 29 through inlet ports 30 and 31 at opposite ends of the cylinder and then through ports 32 and 33 with one-way compressor valves at opposite sides of the piston 15 which is hollow. Heat exchange power shaft ports 34 are provided in shaft 13 to allow passage of air being compressed into shaft 13 and thence into collector 35 where it can be directed selectively through conveyances 36 and 37. Air from conveyance 37 is directed through port 38 in plate 39 where plates 39 and 40 are used to prevent travel of air therefrom in a direction away from the heat exchanger; rather it is directed through the heat exchange media 28 at the outside of the tubes 24. Plates 41 and 42 are employed to prevent escape of the air through the ends of the condenser 23.

The coolant is then directed out of the condenser through expander tube 43 into plenary cylinder 44 and thence through intake ports with actuated intake valves 45 and 46 at opposite ends of double-acting cylinder 47 in which the expander piston 16 is caused to reciprocate. The expander piston performs work in the process of allowing the coolant to expand out of the compressor and transfers this work through shaft 14 to the compressor piston 17, thereby reducing substantially the amount of work input required for compression. The coolant remains partially compressed or optionally under a lower compression ratio because the expander piston is smaller in diameter or lower in effective surface-time ratio than the compressor piston. The reduced pressure coolant is then directed through outlet ports with actuated one-way valves 48 and 49 at opposite ends of the double-acting cylinder 47 and is directed into a portion of the plenary cylinder where it is then directed through evaporation tube 50.

There are three different modes of operation that the device can be made to operate in downstream of the tube 50. The first is a closed-loop refrigerator or air conditioner mode in which the coolant is directed from the tube 50 into an evaporator 51 through tube 53 and out of the evaporator through tube 54. The second mode is an open-loop cycle in which there is no evaporator through tube 54. The second mode is an open-loop cycle in which there is no evaporator but rather the coolant would be air rather than a chemical coolant and the air would be directed from tube 50 through tube 55 into a room or area to be cooled 52 and then directed out of the room 52 through tube 56 and back to the compressor. The third mode of operation is to have both an open-loop and a closed-loop. In this case, air would be used as a refrigerant to be circulated through the evaporator and into the room. Valves 57, 58, 59 and 60 would be employed to direct the air into either one or both of the evaporator and/or cooled area. When either a closed-loop or an open-loop cycle is employed the tube 54 would be eliminated if the closed-cycle were employed.

The evaporator operates in the same way with respect to heat exchange that the condenser does. It has the same components, namely the coolant tube 24 going in and out of the device, the outside tube 25 with orifice 26, high density heat exchange material 27, and high density outside coolant material 28.

Air from the heat exchange cylinder that is directed through tube 37 to the evaporator 51 is directed in between the U-shaped tubing legs of the evaporator through an inlet 61 in a similar manner to the way in which it is directed into inlet 38 in the condenser 23. End plates 62 and 63 are employed to prevent the escape of air through the ends of the evaporator the same as for the end plates 41 and 42 in the condenser. Valves 64 and 65 in tube 36 and 37 respectively are employed to regulate the proportion of cooling air or other media from the heat exchange cylinder 29 into the condenser and evaporator respectively.

The coolant being returned from either the evaporator or the room or both can be directed into the compressor cylinder 18 at either end of the cylinder or it can be directed into the cylinder through the power shaft 14 as is shown in the preferred embodiment depicted herein. The return coolant flow conveyance is shown as tube 66 and terminates inside the drive sleeve 6 area and then is directed further through the hollow shaft section 67 in shaft 14 and then into the hollow piston 17. Intake ports with valves 68 and 69 are provided in opposite faces of the piston 17 for direction of the coolant into alternate ends of the double-acting cylinder 18, thus completing the coolant travel loop. The tube 66 is shown as an integral part of base plate 70 to which the transverse guide is attached at the compressor side of the device.

An opposite transverse guide 71 with similar arrangement is provided for the opposing cam drive for the heat exchange piston. The two base plates are joined by a base 72 to which the device is anchored.

What is claimed is:

1. An opposed counter-beveled cam drive piston refrigeration device having a double-acting counter-beveled cam drive compressor piston in opposed reciprocating travel relationship to a double-acting counter-beveled cam drive heat exchange piston, a compact condenser, coolant fluid outlet ports with one-way valves at each end of a double-ended compressor cylinder in which the compressor piston is caused to travel in reciprocating relationship to the inside periphery of said cylinder, a conveyance means between the outlet ports with valves and the compact condenser, a coolant fluid conveyance means between the condenser and a utilization terminal, inlet ports with one-way valves at each end of the double-acting compressor cylinder in communication with a select portion of recycled coolant from the utilizaton terminal and from outside sources, a conveyance means between the compact condenser and outlet ports with one-way valves at each end of a heat exchange cylinder in which the heat exchange piston is caused to travel in reciprocating relationship thereto.

2. A refrigeration device as described in claim 1 and having a compact evaporator, a conveyance between the outlet of the condenser and an inlet in the evaporator, a restriction causing work to be done by compressed coolant in the conveyance between the condenser and the evaporator, a conveyance between the outlet from the compact evaporator and inlet ports with one-way valves at each end of the compressor cylinder, a conveyance between the heat exchange cylinder outlet ports and the high density evaporator, terminal points in the conveyances between the compressor and the condenser to prevent coolant from flowing out of said conveyances, and terminal points in the conveyances between the evaporator and the compressor inlet ports to prevent escape of coolant therefrom.

3. An opposed counter-beveled cam drive double-acting piston refrigeration device having opposed counter-beveled cam drive grooves around the inside periphery of separate cam drive sleeves rotatably attached to separate base plates, a transverse guide with linear channels inward from each sleeve, a rotational power source attached to the sleeves, a power shaft with a compressor piston and an expander piston attached thereto, a compressor cylinder and an expander cylinder at one side of the opposed counter-beveled cam drive grooves, a power shaft with double-acting heat exchange piston and cylinder at the opposite side of the cam drive sleeves from the compressor and expander cylinders, cam follower drive teeth extended radially from each power shaft into the respective counter-beveled cam drive grooves in sliding contact therewith and in sliding contact with the transverse guide channel walls at the respective sides of the cam drive sleeves at which the respective cylinders are positioned, a compact heat exchange condenser, a conveyance in communication between outlet ports with one-way outlet valves in the compressor cylinder and the compact condenser, intake ports with one-way intake valves at each end of the double-acting heat exchange cylinder, cooling media intake ports with one-way valves at each end of the compressor cylinder, outlet ports with one-way valves at each end of the compressor cylinder, a conveyance in communication between the outlet ports in the compressor cylinder and the compact condenser, inlet ports with one-way valves at each end of the expander cylinder, a conveyance in communication between the condenser and the intake ports in the expander piston, outlet ports with one way valves at each end of the expander cylinder, a cooling terminal, a conveyance from the expander cylinder outlet ports to the cooling terminal and a conveyance from the cooling terminal to the inlet ports of the compressor cylinder.

4. A refrigeration device as described in claim 3 and having an evaporator to which the expander piston outlet conveyance and compressor inlet conveyance are connected.

5. A refrigeration device as described in claim 4 and having a compact evaporator and a conveyance in communication between outlet ports in the heat exchange cylinder and the compact evaporator.

* * * * *